US011298953B2

(12) United States Patent
Mogi et al.

(10) Patent No.: US 11,298,953 B2
(45) Date of Patent: Apr. 12, 2022

(54) PRINTING APPARATUS

(71) Applicant: CANON KABUSHIKI KAISHA, Tokyo (JP)

(72) Inventors: Sae Mogi, Yokohama (JP); Kazuo Suzuki, Yokohama (JP); Shin Genta, Yokohama (JP); Hiroshi Taira, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/917,313

(22) Filed: Jun. 30, 2020

(65) Prior Publication Data

US 2021/0046764 A1 Feb. 18, 2021

(30) Foreign Application Priority Data

Aug. 15, 2019 (JP) ..... JP2019-149062

(51) Int. Cl.
*B41J 2/045* (2006.01)
*B41J 2/175* (2006.01)

(52) U.S. Cl.
CPC ..... *B41J 2/17596* (2013.01); *B41J 2/045* (2013.01)

(58) Field of Classification Search
CPC .... B41J 2/17596; B41J 2/045; B41J 2/16508; B41J 2/16526; B41J 2/175; B41J 2/17509
See application file for complete search history.

(56) References Cited

U.S. PATENT DOCUMENTS

| | | | | |
|---|---|---|---|---|
| 9,694,593 | B2 | 7/2017 | Kuribayashi | B41J 2/17596 |
| 9,738,087 | B2 | 8/2017 | Kato et al. | B41J 2/17566 |
| 10,059,116 | B2 | 8/2018 | Kuribayashi | B41J 2/17509 |
| 2009/0295888 | A1 | 12/2009 | Nitta et al. | 347/89 |
| 2016/0067982 | A1 | 3/2016 | Kuribayashi | 347/85 |
| 2016/0347078 | A1 | 12/2016 | Kato et al. | B41J 2/16505 |
| 2017/0239955 | A1 | 8/2017 | Kuribayashi | B41J 2202/12 |
| 2019/0232671 | A1 | 8/2019 | Danzuka et al. | B41J 2/16532 |
| 2020/0338900 | A1* | 10/2020 | Morikawa | B41J 2/17513 |

FOREIGN PATENT DOCUMENTS

| | | |
|---|---|---|
| JP | H09-327929 | 12/1997 |
| JP | 2010-064477 | 3/2010 |
| JP | 2010-201698 | 9/2010 |
| JP | 2016-52769 | 4/2016 |

* cited by examiner

*Primary Examiner* — Lamson D Nguyen
(74) *Attorney, Agent, or Firm* — Venable LLP

(57) ABSTRACT

A printing apparatus includes an ink tank that stores ink, a supply tube that supplies the ink from the ink tank, and a printing head that includes therein a pressure chamber arranged with an ejection port to eject the ink and performs reciprocal moving. The printing head includes a first liquid chamber that includes a connection portion with the supply channel, a second liquid chamber that communicates with the first liquid chamber by way of the pressure chamber, and a volume variable unit that changes an inner volume of the second liquid chamber.

16 Claims, 12 Drawing Sheets

PRINTING APPARATUS

BACKGROUND OF THE INVENTION

Field of the Invention

The present disclosure relates to a printing apparatus.

Description of the Related Art

There has been a so-called serial type ink jet printing apparatus in which a printing operation is performed by repeating movement of a printing head in a main scanning direction and conveyance of a printing medium. Japanese Patent Laid-Open No. 2016-52769 (hereinafter called Patent Literature 1) discloses an ink jet head including a collection side ink chamber, a supply side ink chamber, and an ink circulation device in a serial type ink jet printing apparatus. In Patent Literature 1, the collection side ink chamber, the supply side ink chamber, and the ink circulation device are integrally formed with the ink jet head above the ink jet head. There is disclosed that the ink circulation device includes an ink circulation pump and a pressure sensor and circulates ink between ink chambers through nozzles by driving the ink circulation pump.

The technique disclosed in Patent Literature 1 includes the ink circulation device integrally formed with the ink jet head, and many parts such as the ink circulation pump and the pressure sensor are used in the ink circulation device. For this reason, if the technique disclosed in Patent Literature 1 is used to circulate the ink near the nozzle, there is a case that the configuration of the printing head may be complicated, or the controls of the apparatus may be complicated.

SUMMARY OF THE INVENTION

The printing apparatus according to an aspect of the present disclosure is a printing apparatus, including: a tank configured to store ink; a printing head provided with an ejection port to eject ink and a pressure chamber to be filled with ink and configured to perform reciprocal moving; and a supply channel configured to supply ink from the tank to the printing head, in which the printing head includes a first liquid chamber provided with a connection portion with the supply channel, a second liquid chamber configured to communicate with the first liquid chamber by way of the pressure chamber, and a volume variable unit configured to change an inner volume of the second liquid chamber.

Further features of the present invention will become apparent from the following description of exemplary embodiments with reference to the attached drawings.

DESCRIPTION OF THE EMBODIMENTS

Figure 1:
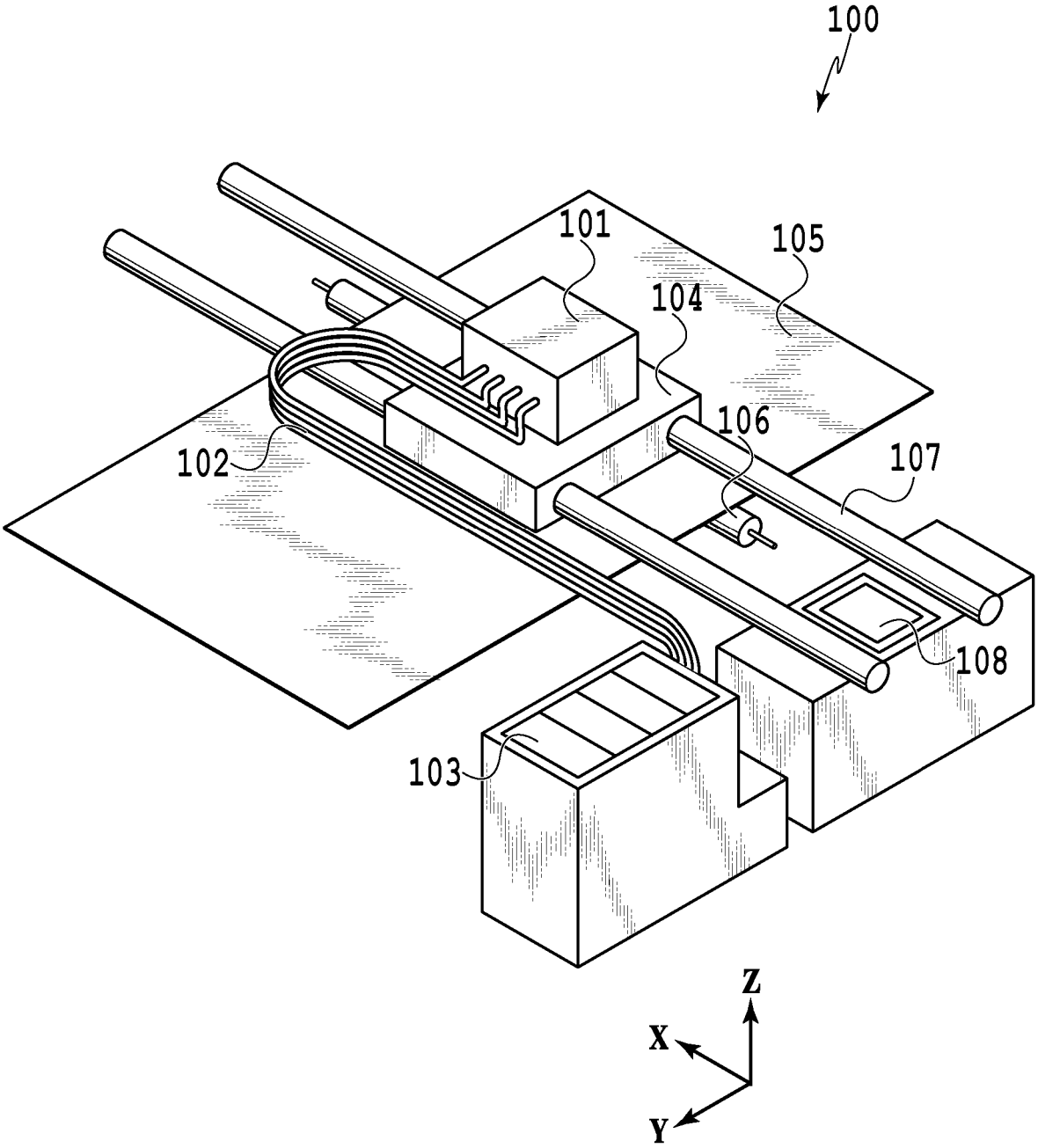
FIG. 1 is a schematic perspective view illustrating the appearance of a printing apparatus.

Hereinafter, embodiments according to the present disclosure are described with reference to the drawings. The following embodiments are not intended to limit the present disclosure, and not all the combinations of the characteristics described in those embodiments are necessarily required. The same configurations are described with the same reference numerals assigned thereto.

"Print" herein is not limited to a case of forming significant information such as a letter or a figure and is regardless of whether the information is significant or not. Additionally, "print" herein also indicates a case of forming an image, designs, patterns, or the like widely on a printing medium or a case of performing processing of a printing medium, regardless of whether they are visible to be sensed visually by humans.

"Ink" (also called "liquid") should be construed widely as with the definition of the above-described "print". Accordingly, "ink" indicates a liquid that can be applied on a printing medium and provided for forming of an image, designs, patterns, or the like, processing of a printing medium, or processing of ink (for example, solidification or insolubilization of a colorant in the ink applied to a printing medium).

"Printing medium" indicates not only a sheet of paper used in the general printing apparatus but also indicates widely a cloth, a plastic film, a metallic plate, glass, ceramics, wood, leather, or the like which is ink-acceptable.

First Embodiment

In this embodiment, a so-called serial type ink jet printing apparatus that performs a printing operation by repeating movement of a printing head in a main scanning direction and conveyance of a printing medium in a direction crossing the main scanning direction (hereinafter, called sub scanning direction) is described. Additionally, a mode of moving ink near an ejection port in the ink jet printing apparatus (hereinafter, simply called printing apparatus) is described.

First, the background of why the ink near the ejection port is demanded to be moved is described schematically. The printing head of the printing apparatus is configured to eject the ink from the ejection port by driving an energy generation element (printing element) arranged in a pressure chamber. The energy may be applied by using a thermoelectric conversion element (heater), a piezoelectric element, or the like. The ink filled in the pressure chamber is ejected from the ejection port by driving the energy generation element.

If the ink is not ejected from the ejection port during the printing operation for a while, evaporation components of the ink are evaporated in a meniscus that is an interface between the ink and the ambient air in the ejection port. This increases the density and the viscosity of the ink near the ejection port, and the ejection port is likely to be clogged. In order to inhibit this phenomenon, in general, the serial type printing apparatus performs processing of discharging the ink in which the characteristics are changed near the ejection port by ejecting the ink from the ejection port to the outside of the printing range of the printing medium during the reciprocal movement of the printing head. This processing is called preliminary ejection processing (or flushing processing). The preliminary ejection processing is executed every several times of reciprocation. If a higher image quality is required, the preliminary ejection processing is executed every reciprocation, and at a maximum, the preliminary ejection processing is executed every forward path and every return path. This preliminary ejection processing reduces the printing speed and causes extra time for printing. Additionally, ink that is not used to print an image is consumed. Moreover, there is also required a configuration to process the waste ink discharged by the preliminary ejection.

In this embodiment, an example of moving the ink near the ejection port is described. This makes it possible to inhibit the evaporation of the evaporation components of the ink near the ejection port, and thus the thickening of the ink near the ejection port can be inhibited without performing the preliminary ejection processing. In this embodiment, the characteristics of the serial type printing head are used to move the ink near the ejection port from the ejection port. To be more specific, an example of moving the ink near the ejection port by using a pressure variation that occurs in a tube communicating with the printing head during the reciprocal moving of the printing head is described. That is, an example of inhibiting the thickening of the ink near the ejection port with a simple configuration in which no circulation mechanism such as a pump to move the ink near the ejection port is provided is described.

<Appearance of Printing Apparatus>

FIG. 1 is a schematic perspective view illustrating the appearance of a printing apparatus 100 in this embodiment. The printing apparatus 100 includes a printing head 101. The printing head 101 includes arranged multiple ejection ports that allow ejection of different colors of ink from the corresponding arrays of the ejection ports. The printing head 101 communicates with an ink tank 103 by way of supply tubes 102 serving as supply channels. The ink tank 103 is provided and fixed at a predetermined position in the printing apparatus 100. The ejection port array of each ink color of the printing head 101 is supplied with each color of ink from the ink tank 103 through each supply tube 102 of the corresponding color. Once the ink is ejected from the ejection port, the ink tank 103 supplies ink to the printing head 101.

The printing head 101 is mounted detachably on a carriage 104. In the printing operation, the carriage 104 reciprocally moves along guide shafts 107 in the main scanning direction in a coordinate axis X direction. Along with the movement of the carriage 104, the printing head 101 is moved in the main scanning direction integrally with the carriage 104. The printing medium 105 is conveyed in the sub scanning direction in a coordinate axis Y direction by a conveyance roller 106. While waiting and not performing the printing operation, the ejection port of the printing head 101 is capped by a cap 108. The position in which the ejection port of the printing head 101 capped by the cap 108 is the position in which the printing head 101 is waiting.

The carriage 104 reciprocally moves along the X direction with the printing head 101. Specifically, the carriage 104 is supported movably along the guide shafts 107 arranged along the X direction and is fixed to a not-illustrated endless belt moving substantially parallel to the guide shafts 107. The endless belt is reciprocally operated by driving force of a carriage motor (CR motor), and this allows the carriage 104 to reciprocally move in the X direction.

<Ink Path>

Figure 2:
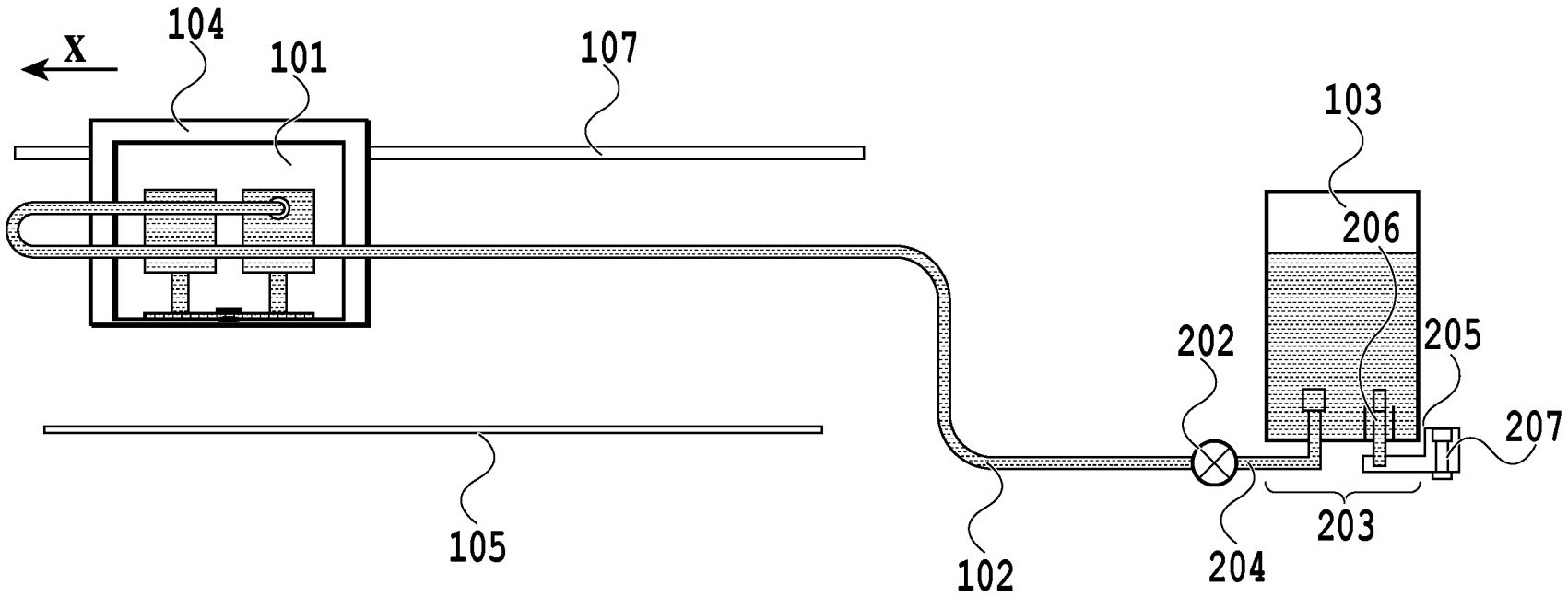
FIG. 2 is a diagram illustrating a path of ink from an ink tank to a printing head.

FIG. 2 is a schematic diagram viewing the printing apparatus 100 from a +Y direction in FIG. 1. FIG. 2 illustrates a path of one color of ink from the ink tank 103 arranged at a certain position in the apparatus main body to the printing head 101.

An ink supply system 203 including the ink tank 103 includes a hollow pipe 204 and a buffer chamber 205 and is held and fixed at a predetermined position in the main body of the printing apparatus 100. The supply tube 102 is used as an ink channel. The supply tube 102 is connected to the ink supply system 203 by way of an openable opening/closing valve 202. The supply tube 102 is formed of a soft (flexible) material and is capable of supplying the ink to the printing head 101 while moving the carriage 104 reciprocally in the X direction. The supply tube 102 can be connected to the printing head 101 at an arbitrary position in the printing head 101. The supply tube 102 is arranged to have a section substantially parallel to the moving direction of the carriage 104. Details are described later. Arrangement of the supply tube 102 illustrated in FIGS. 1 and 2 is merely an example and is not limited to the example.

Next, a method of supplying the ink from the ink tank 103 is described. The ink tank 103 is detachably mounted in the main body of the printing apparatus 100. The ink tank 103 is connected with the supply tube 102 by the hollow pipe 204. The opening/closing valve 202 that can open and close the channel is provided in the supply tube 102. The opening/closing valve 202 is configured to open if the power source of the printing apparatus 100 is turned ON and to close if the power source is turned OFF. That is, during the printing operation, the opening/closing valve 202 is in the open state. The opening/closing valve 202 may be configured such that the opening/closing valve 202 closes even after the power source is turned ON and opens once a printing command is inputted to the printing apparatus 100. The ink tank 103 is connected to and communicates with the buffer chamber 205 by a narrow pipe 206. The connection position of the ink tank 103 and the narrow pipe 206 is substantially lower side in the ink tank 103 like the connection position of the ink tank 103 and the hollow pipe 204. The buffer chamber 205 is connected to and communicates with the ink tank 103 by the narrow pipe 206 similar to the hollow pipe 204. The buffer chamber 205 is connected to the ink tank 103 while being connected to a communication pipe 207 for opening to the atmosphere. This makes a balance between the internal pressure of the ink tank 103 and the atmosphere pressure. The narrow pipe 206 connecting the buffer chamber 205 and the ink tank 103 has a configuration of a sufficiently narrow channel to minimize the ink evaporation in the ink tank 103 while implementing the communication between the ink tank 103 and the buffer chamber 205.

<Block Diagram>

Figure 3:
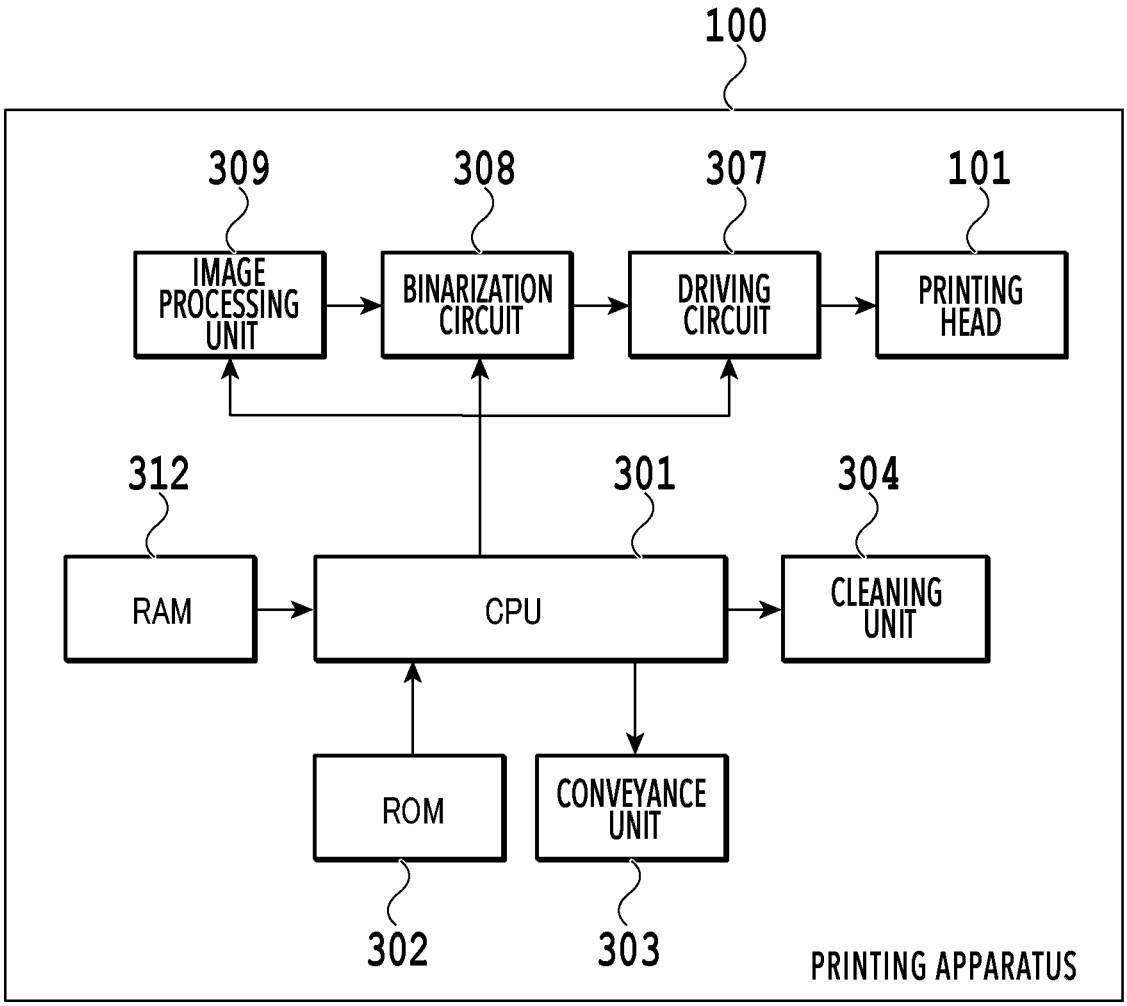
FIG. 3 is a block diagram illustrating a schematic control configuration of the printing apparatus.

FIG. 3 is a block diagram illustrating a schematic control configuration of the printing apparatus 100 of this embodiment. A CPU 301 reads out a program for controlling the system from a ROM 302 to a RAM 312 to execute and controls the overall system according to the executed program. The RAM 312 is used as a work region for temporarily storing a program, input data, and the like required for the processing executed by the CPU 301.

The CPU 301 controls operations of a cleaning unit 304, a conveyance unit 303, and the like. The conveyance unit 303 controls the driving of the conveyance roller 106. The CPU 301 also controls the printing operation of the printing head 101 through a driving circuit 307, a binarization circuit 308, and an image processing unit 309. The image processing unit 309 performs predetermined image processing on inputted color image data to be printed. For example, the image processing unit 309 executes data conversion to map a color gamut reproduced by the inputted image data of RGB color components into a color gamut reproduced by the printing apparatus. Based on the converted data, the image processing unit 309 performs processing of obtaining CMYK component density data that is color separation data corresponding to combinations of ink reproducing the colors indicated by the data, and performs gradation conversion on each piece of color separation data separated into the corresponding color.

The binarization circuit 308 performs half tone processing and the like on the multi-value density image data converted by the image processing unit 309 and then converts the data to binary data (bitmap data). According to the binary data and the like obtained by the binarization circuit 308, the driving circuit 307 executes an ink ejection operation by the printing head 101. The CPU 301 controls the conveyance of the printing medium 105 by the conveyance unit 303 correspondingly to the printing operation by the printing head 101 to print an image on the printing medium 105.

<Liquid Chamber of Printing Head>

Figure 4A:
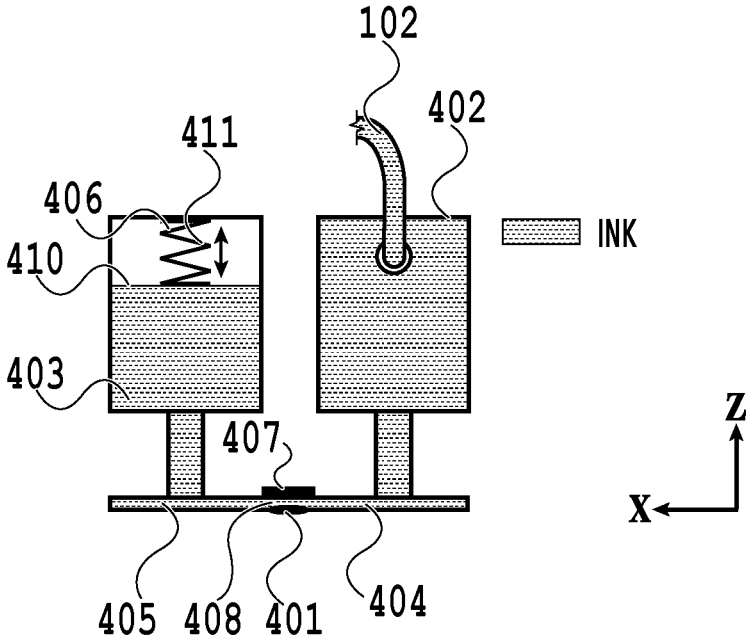
FIGS. 4A and 4B are diagrams describing liquid chambers in the printing head.
Figure 4B:
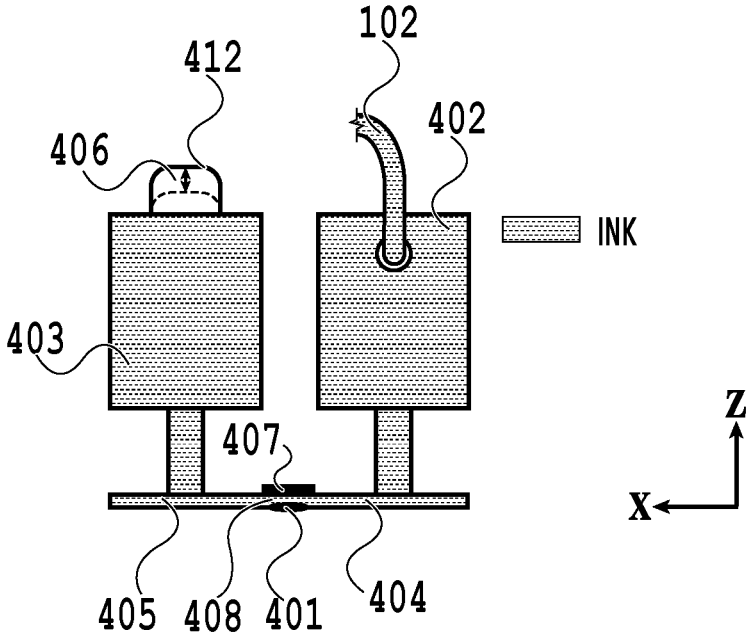

FIGS. 4A and 4B are diagrams describing liquid chambers in the printing head 101. FIG. 4A is a schematic cross-sectional view of the printing head 101 of this embodiment. Ejection ports 401 are arranged in a direction away from the sheet surface. A heater 407 as the energy generation element is arranged in a pressure chamber 408 of the printing head 101. Bubbles are generated by applying electric power in the form of pulse to the heater 407, and an ink droplet is ejected from each ejection port 401.

The printing head 101 includes two liquid chambers, which are a first liquid chamber 402 and a second liquid chamber 403 sandwiching the ejection port 401. The first liquid chamber 402 is a liquid chamber connected to the supply tube 102. The second liquid chamber 403 is a liquid chamber positioned opposite of the first liquid chamber 402 with respect to the ejection port 401. A first channel 404 is a channel connecting each ejection port 401 and the first liquid chamber 402. A second channel 405 is a channel connecting each ejection port 401 and the second liquid chamber 403.

The second liquid chamber 403 includes a volume variable unit 406. The volume variable unit 406 is a member capable of changing the inner volume inside the liquid chamber. In FIG. 4A, the volume variable unit 406 includes an elastic member 411 in the form of bellows and a liquid chamber inner wall 410 to which the elastic member 411 is joined and movable by the elastic member 411. FIG. 4B is a diagram illustrating an example in which the configuration of the volume variable unit 406 is different from that of the example illustrated in FIG. 4A. In FIG. 4B, the volume variable unit 406 is an elastic member 412 in the form of rubber.

As illustrated in FIGS. 4A and 4B, a mechanism expanded and contracted according to pressure or a flexible member is used for the volume variable unit 406. For example, during the pressurizing in a direction from the first liquid chamber 402 to the second liquid chamber 403, the volume variable unit 406 is changed, and the inner volume of the second liquid chamber 403 is expanded. This makes it possible to temporarily store, in the second liquid chamber 403, the ink shaken by the reciprocal moving while preventing overflowing of the ink from the ejection port 401.

Figure 5:
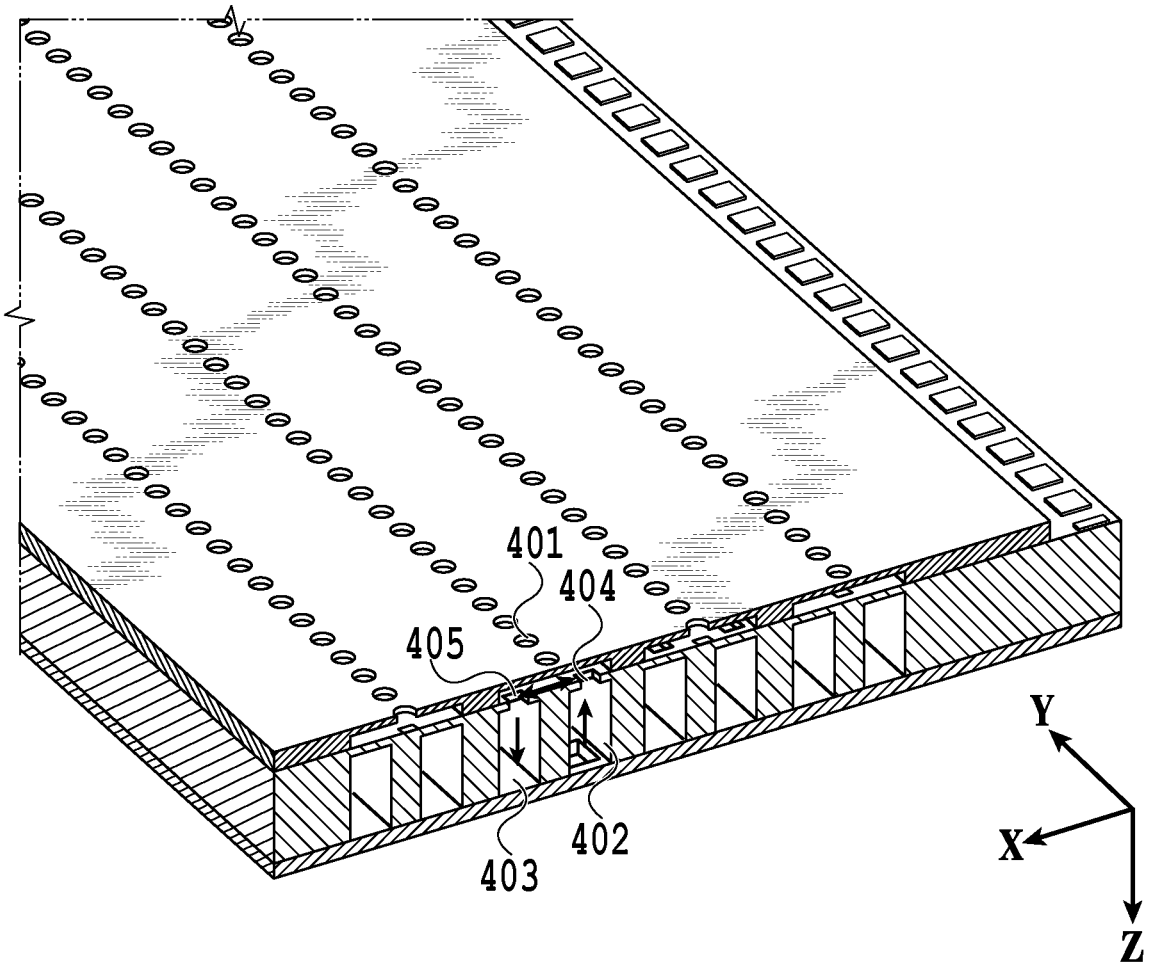
FIG. 5 is a cross-sectional perspective view of the printing head.

FIG. 5 is a cross-sectional perspective view of the printing head 101 viewed from the surface in which the ejection ports 401 are formed. The ejection ports 401 are arranged in the form of array. The first channel 404 and the second channel 405 are arranged with respect to the ejection ports 401. The first liquid chamber 402 and the second liquid chamber 403 extend along the ejection port array. That is, the ink of the first liquid chamber 402 can pass through the first channel 404, each ejection port 401, and then second channel 405 to converge into the second liquid chamber 403. The printing head 101 includes multiple colors of ink, and there are arranged multiple arrays of the ejection ports 401.

<Description of Inertial Force along with Movement of Carriage>

FIGS. 6A to 6D are diagrams describing inertial force along with the movement of the carriage 104. The printing head 101 coupled with the ink tank 103 by the supply tube 102 is moved reciprocally rightward and leftward in the X-axis direction of FIG. 1 as the main scanning direction integrally with the carriage 104. That is, in FIGS. 6A to 6D, the carriage 104 moves reciprocally rightward and leftward. The reciprocal movement of the carriage 104 may be performed in the printing operation or may be performed while not performing the printing operation.

Figure 6A:
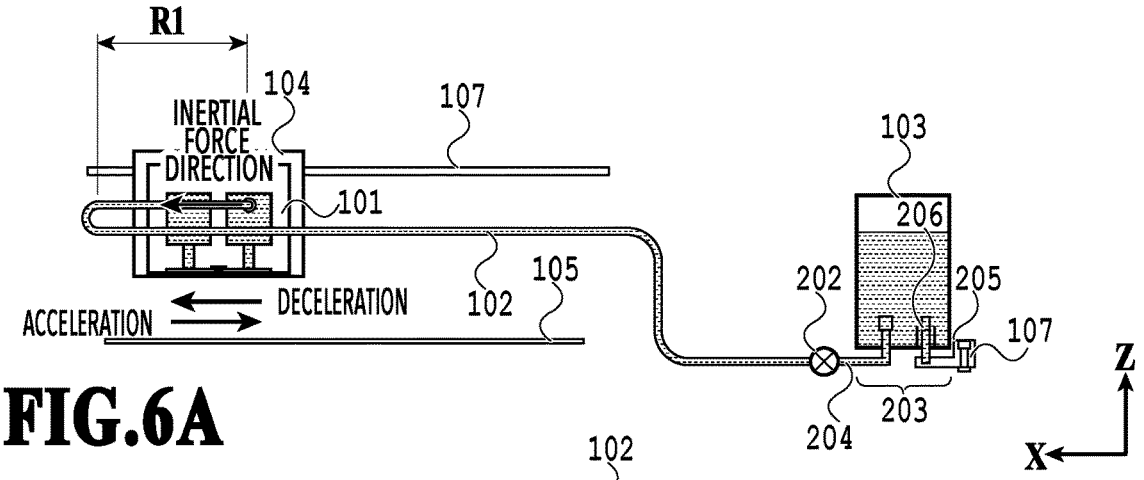
FIGS. 6A to 6D are diagrams describing inertial force along with movement of a carriage.
Figure 6B:
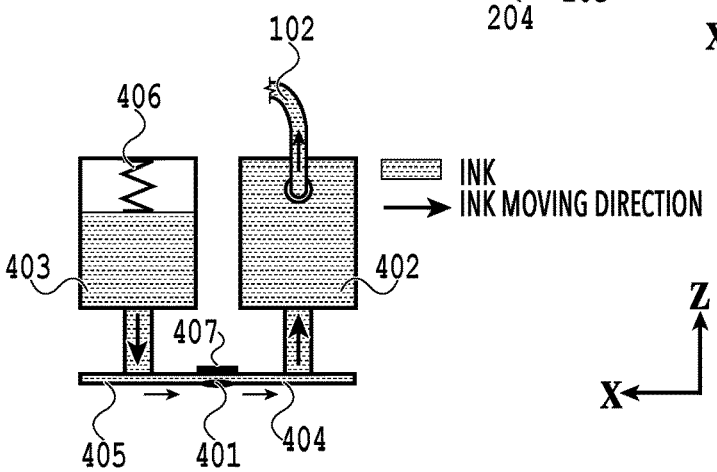

FIG. 6A is a schematic diagram of the arrangement of the supply tube 102 after the carriage 104 moves to a left end side in the main scanning direction. The left end side is a +X direction side in FIGS. 1 and 6A and is a left end side on the sheet surface of FIG. 6A. While the carriage 104 accelerates and decelerates on the left end side in the main scanning direction, inertial force is generated in the ink in the supply tube 102. Specifically, as illustrated in FIG. 6A, the inertial force is generated in a direction leftward of FIG. 6A in the ink in a region R1 (region moved along with the movement of the carriage 104) in the supply tube 102. The inertial force affecting the region R1 in the supply tube 102 is generated in a direction from the print head 101 to the ink tank 103 in a view of the whole channel. As described above, the opening/closing valve 202 is in the open state, and the ink tank 103 communicating with the supply tube 102 is opened to the atmosphere. Thus, if the inertial force is generated as illustrated in FIG. 6A, the ink flows in a direction from the second liquid chamber 403 to the first liquid chamber 402 as illustrated in FIG. 6B.

Figure 6C:
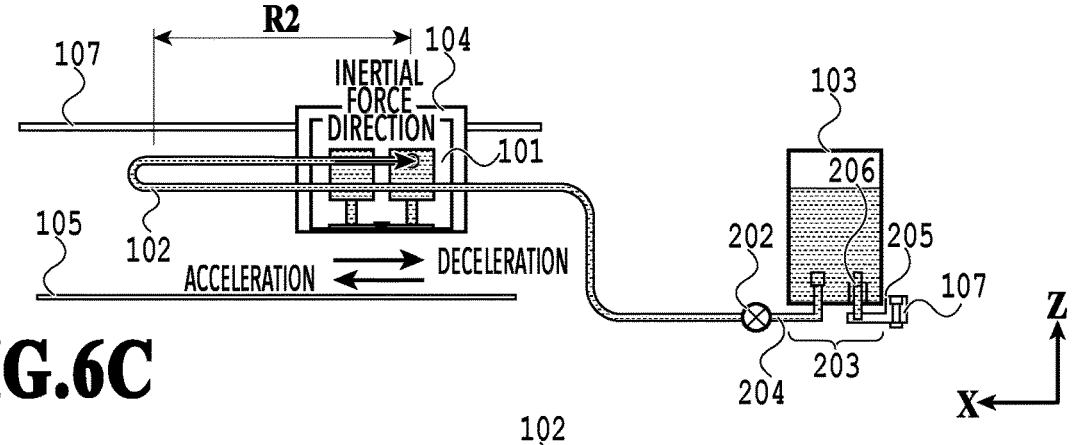
Figure 6D:
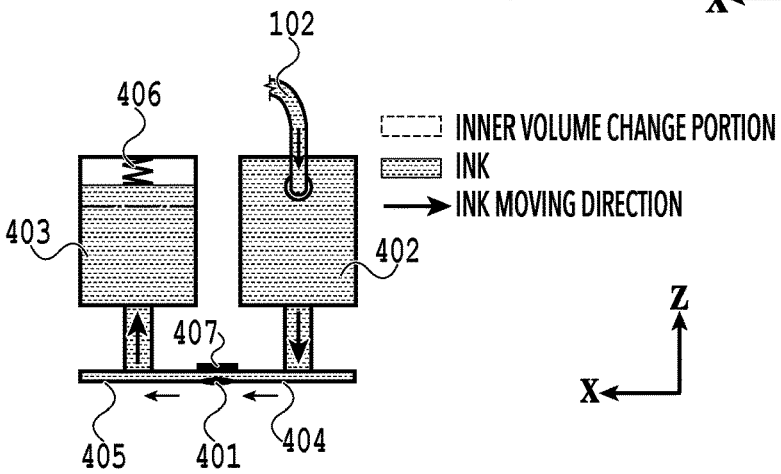

FIG. 6C is a schematic diagram of the arrangement of the supply tube 102 after the carriage 104 moves to a right end side in the main scanning direction. The right end side is a −X direction side in FIGS. 1 and 6C and is a right end side on the sheet surface of FIG. 6C. While the carriage 104 accelerates and decelerates on the right end side in the main scanning direction, inertial force is generated in the ink in the supply tube 102. Specifically, as illustrated in FIG. 6C, the inertial force is generated in a direction rightward of FIG. 6C in the ink in a region R2 (region moved along with the movement of the carriage 104) in the supply tube 102. The inertial force affecting the region R2 in the supply tube 102 is generated in a direction from ink tank 103 to the printing head 101 in the view of the whole channel. That is, a pressure by the inertial force is applied in a direction from the first liquid chamber 402 to the second liquid chamber 403 in the printing head 101. In this embodiment, as illustrated in FIG. 6D, the volume variable unit 406 expands the inner volume of the second liquid chamber 403 and makes it possible to store the ink flowed due to the pressurization. Thus, the ink is not leaked from the ejection port 401 due to the pressurization and flows in a direction from the first liquid chamber 402 to the second liquid chamber 403.

As described in FIGS. 6A to 6D, the ink near the ejection port 401 is moved reciprocally with the carriage 104 performing the acceleration and deceleration scanning on the right and left ends. That is, it is possible to move the ink near the ejection port 401 without using a pump for circulation and the like.

It is assumed that the volume variable unit 406 can be expanded according to the conceivable maximum pressure variation due to the acceleration and deceleration of the carriage 104. For example, if the printing apparatus 100 includes the supply tube 102 arranged as illustrated in FIG. 1, the conceivable maximum pressure variation is a pressure variation that occurs during scanning at the maximum scanning width and acceleration and deceleration on the right end side. The arrangement of the supply tube 102 as illustrated in FIG. 1 is the configuration in which the supply tube 102 is arranged in a direction substantially parallel to the moving direction of the carriage 104. The length of the supply tube 102 that is moved along with the movement of the carriage 104 has a configuration that allows the region R2 with the carriage 104 positioned on the right end side as illustrated in FIG. 6C to be longer than the region R1 with the carriage 104 positioned on the left end side as illustrated in FIG. 6A. The volume variable unit 406 may be expandable by the maximum pressure variation or more.

In FIGS. 6A to 6D, the example in which the supply tube 102 is connected so as to form a lateral letter J and is routed in the substantially J shape is described. Also, the example in which the routing direction of the supply tube 102 is not changed between the case where the carriage moves to the left end side and the case where the carriage moves to the right end side is described. FIGS. 6A to 6D illustrate the example in which, near the connection portion of the first liquid chamber 402 and the supply tube 102, the supply tube 102 is connected to the first liquid chamber 402 while being routed around from the left side of the drawing. In this case, the inertial force affects the ink in the supply tube 102 (R1 illustrated in FIG. 6A and R2 illustrated in FIG. 6C) moved along with the movement of the carriage 104. Thus, if the routing direction of the entire supply tube 102 is not changed during the movement of the carriage, the ink is moved in the same direction even if the supply tube 102 is connected to the first liquid chamber 402 from any direction near the connection portion.

Figure 7A:
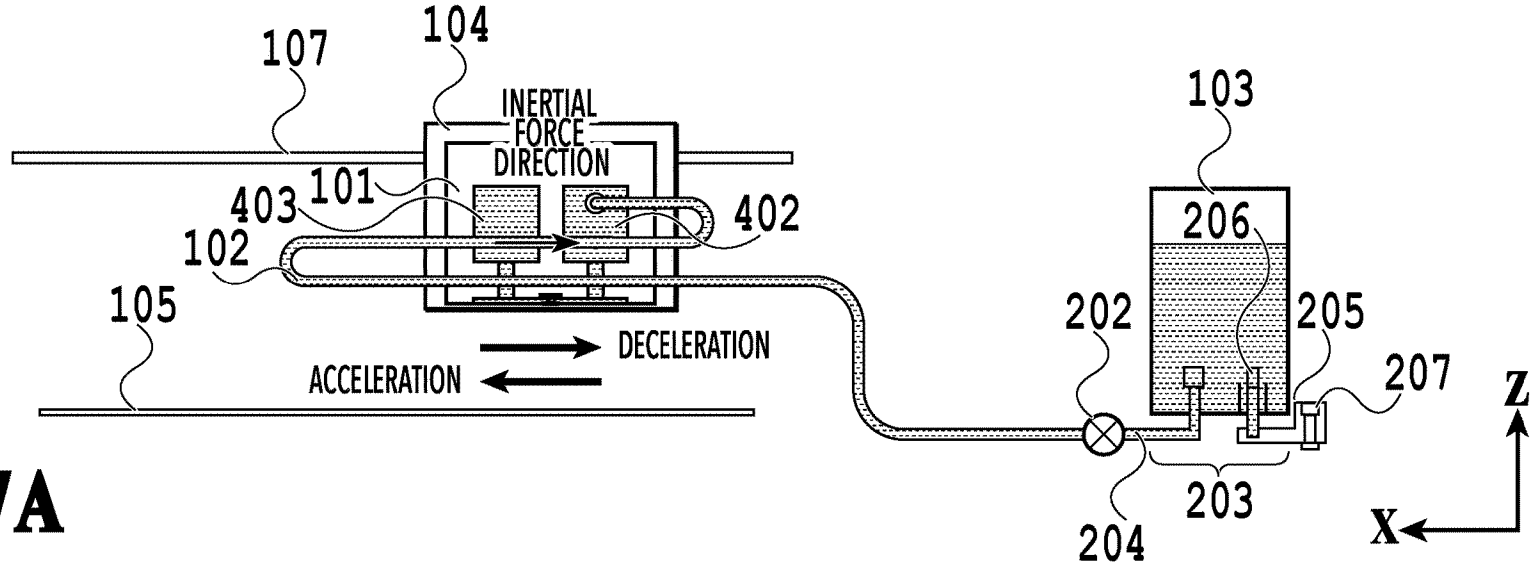
FIGS. 7A and 7B are diagrams describing the inertial force along with the movement of the carriage.
Figure 7B:
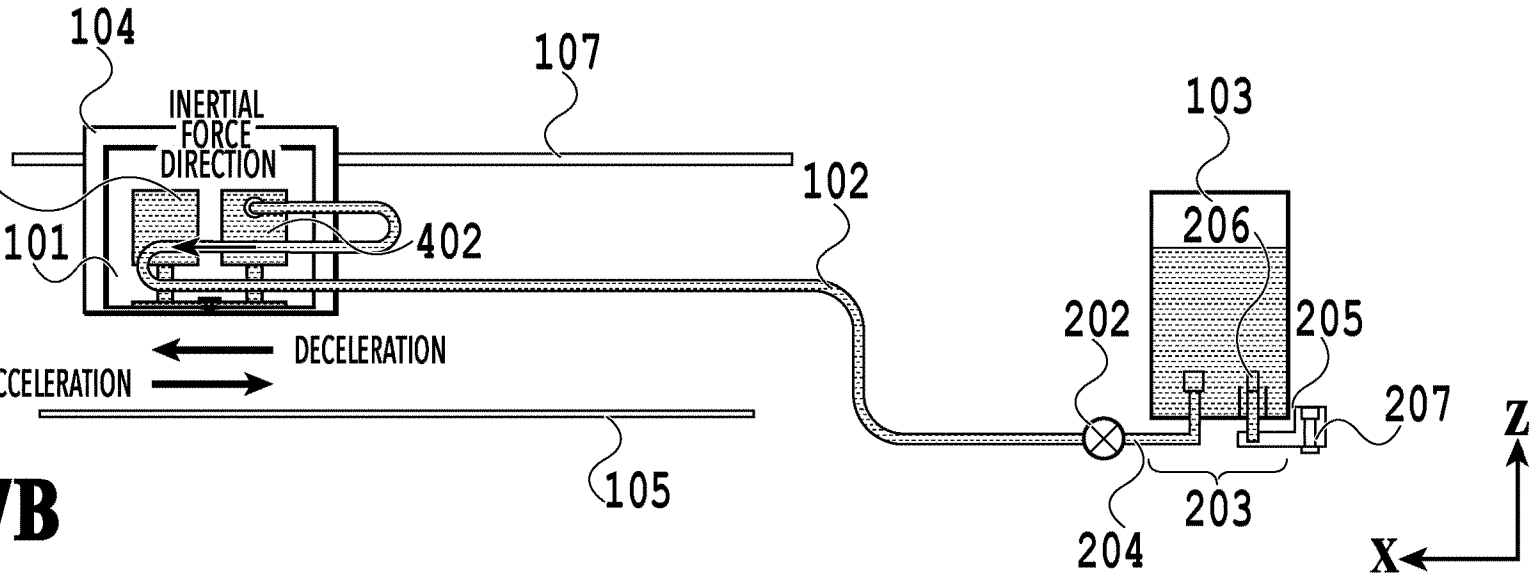

FIGS. 7A and 7B are other diagrams describing the inertial force along with the movement of the carriage 104. FIG. 7A is an example in which the carriage 104 is positioned on the right end side in the main scanning direction. FIG. 7B is an example in which the carriage 104 is positioned on the left end side in the main scanning direction. Also in the examples of FIGS. 7A and 7B, the entirety of the supply tube 102 is routed in the substantially J shape like a lateral letter J. In the examples of FIGS. 7A and 7B, the vicinity of a tip end portion of the letter J of the supply tube 102 (connection portion with the first liquid chamber 402) is connected to the first liquid chamber 402 while being routed around from the right side of FIGS. 7A and 7B, opposite of the examples illustrated in FIGS. 6A to 6D. Even in this mode, the portion in which the inertial force along with the movement of the carriage 104 is generated is the portion of the supply tube 102 indicated by an arrow that is moved along with the movement of the carriage 104. Thus, even if the supply tube 102 is connected to the first liquid chamber 402 while being curved further in the vicinity of the connection portion with the first liquid chamber 402, the direction in which the inertial force along with the movement of the carriage 104 is generated is similar to that of the example illustrated in FIGS. 6A to 6D.

<Description of Movement of Ink>

Next, phenomena that occur with the ink near the ejection port 401 moved are described. As described above, the evaporation components of the ink are evaporated in the meniscus as the interface of the ink and the ambient air of the ejection port 401. The evaporation components of the ink are likely to be evaporated more as the temperature of the ink is higher. Additionally, the evaporation components of the ink are likely to be evaporated as the humidity of the ambient air is lower. Thus, the ink near the ejection port 401 has a possibility that the characteristics are changed and degradation of the ejection accuracy and the ejection failure due to the clog in the ejection port 401 may occur.

In order to recover the ejection port 401 in which the ink with the changed characteristics is stagnating, the ink stagnating in the ejection port 401 needs to be replaced with ink with the original characteristics. The ink with the changed characteristics has higher viscosity and density and a slower ejection speed than that of ejection by normal ink. This causes the impact position on the printing medium to be offset from the desirable impact position, and the image quality of the printed image may be degraded. Additionally, a change in the volume and an increase in the printing density of the ejected ink also cause the image quality degradation of the printed image. Thus, in order to maintain the desirable ink ejection, it is required to move the ink in which the characteristics are changed due to the evaporation at the meniscus near the ejection port 401 from the vicinity of the ejection port 401 (at least, the meniscus portion).

In this embodiment, as described above, with the ink near the ejection port 401 moved along with the reciprocal movement of the carriage 104, the ink thickened near the ejection port 401 is mixed with the not-thickened ink and is loosened.

Figure 8:
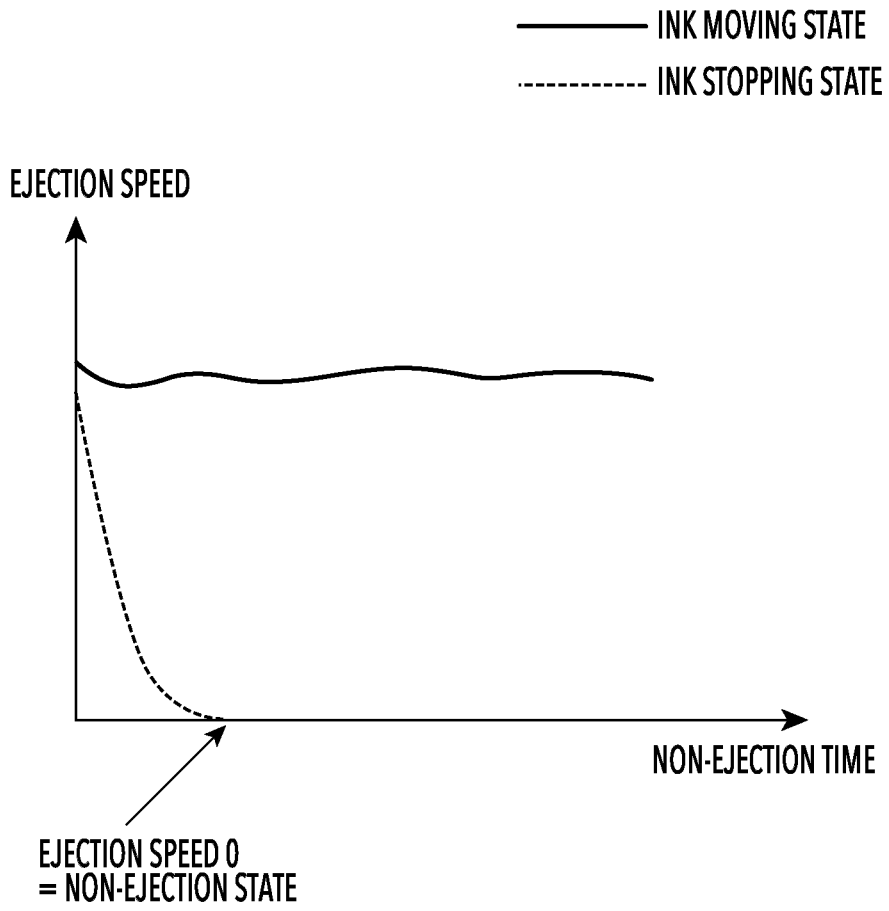
FIG. 8 is a diagram illustrating a change in an ejection speed with respect to a length of non-ejection time during a printing operation.

FIG. 8 illustrates a change in an ejection speed with respect to a length of non-ejection time during the printing operation. FIG. 8 is a diagram illustrating results of actually measuring the ejection speed in a case of generating flows by the inertial force near the ejection port 401 at constant intervals (ink moving state) and a case of generating no flows (ink stopping state). The measurement uses an ejection observation jig that can perform continuous ejection at a constant frequency by applying an arbitrary driving pulse with the fixed printing head 101. The ejected droplet is captured by strobes with different light emission delays to convert the difference of the droplet positions into speed. If there is no ink flow near the ejection port 401, the ink near the ejection port 401 is evaporated with long non-ejection time, and the ejection speed becomes slow immediately. Eventually, the evaporation progresses, and the ink is thickened and reaches the non-ejection state (see dotted line in FIG. 8). On the other hand, in the printing apparatus 100, if the ink is reciprocally moved near the ejection port 401 by the reciprocal moving of the carriage 104, the progress of the evaporation of the ink stagnating near the ejection port 401 is inhibited. This makes it possible to inhibit the decrease in the ejection speed and to maintain the normal ejection state (see solid line in FIG. 8).

As described above, in this embodiment, it is possible to inhibit the change in the characteristics of the ink by generating ink flows near the ejection port 401 during the acceleration and deceleration scanning on the right and left ends by the carriage 104. The use of the reciprocal movement of the carriage 104 that is the characteristics of the serial type makes it possible to move the ink near the ejection port 401 without using a circulation pump and the like. Since the change in the characteristics of the ink can be inhibited by moving the ink near the ejection port 401, it is possible to omit the above-described preliminary ejection operation performed during the scanning of the carriage 104. This allows continuous printing operations without performing the preliminary ejection processing, and the total printing time can be shortened. Additionally, the ink consumption along with the preliminary ejection processing can be reduced. According to the printing apparatus 100 of this embodiment, it is possible to use a high-viscosity ink or the like that has been difficult to be ejected normally even with the preliminary ejection processing, and it is possible to provide the printing apparatus 100 with improved degrees of freedom of ink.

The printing apparatus 100 described in this embodiment can be applied to any printing apparatuses as long as the printing apparatus is the serial type. In a case of a printing apparatus that prints a large printing such as a wide-format printing, the time required for the reciprocal movement is longer, and thus the characteristics of the ink near the ejection port 401 not used for ejection are likely to be changed. With the configuration described in this embodiment, it is possible to considerably reduce the printing time of the large printing apparatus especially for performing the continuous printing operations. There is described that the printing apparatus 100 of this embodiment can perform the continuous printing operations without performing the preliminary ejection processing; however, it is needless to say that the printing apparatus 100 of this embodiment can perform the preliminary ejection processing.

Second Embodiment

In the second embodiment, an example in which the configuration of the volume variable unit 406 is different from that of the first embodiment is described. The volume variable unit 406 of the second embodiment has a different expansion and contraction speed of the inner volume from that of the volume variable unit 406 of the first embodiment.

Figure 9A:
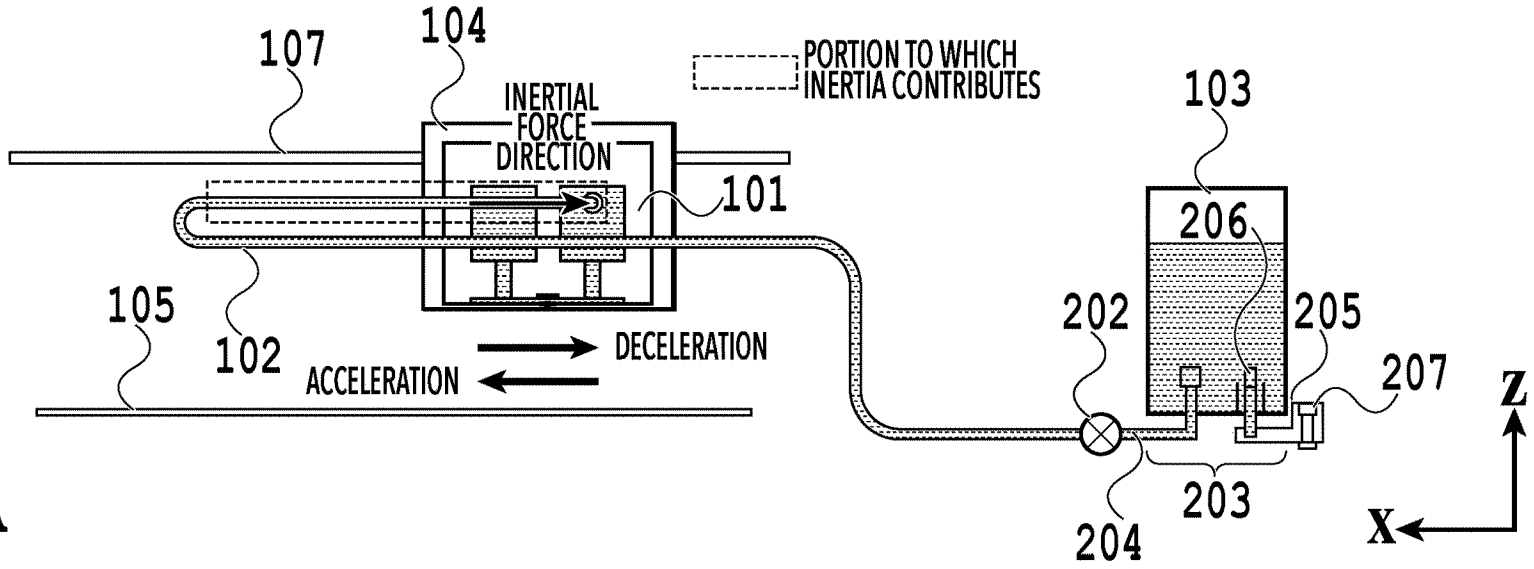
FIGS. 9A and 9B are diagrams describing a portion to which the inertial force contributes.
Figure 9B:
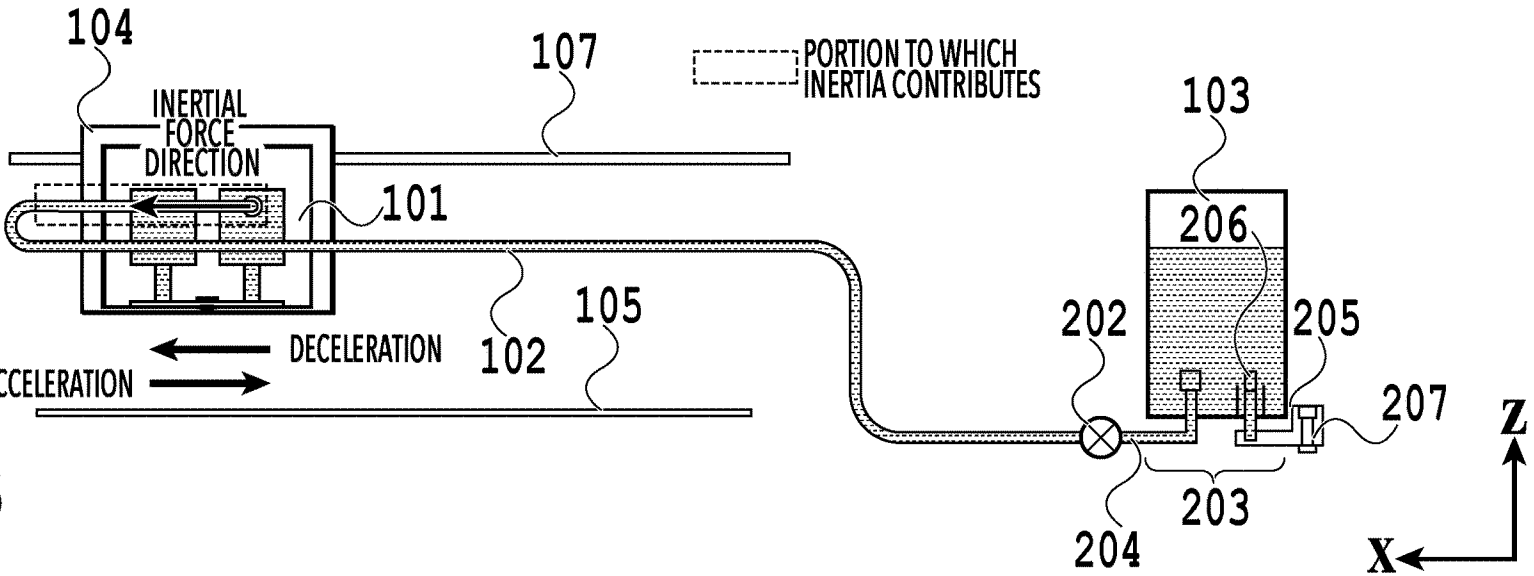

FIGS. 9A and 9B are diagrams describing portions to which the inertial force contributes. FIG. 9A illustrates a portion of the supply tube 102 to which the inertial force contributes while the carriage 104 accelerates and decelerates on the right end side in the main scanning direction with a frame of dotted lines. FIG. 9B illustrates a portion of the supply tube 102 to which the inertial force contributes while the carriage 104 accelerates and decelerates on the left end side in the main scanning direction with a frame of dotted lines. That is, the inertial force contributes to different portions on the right end side and the left end side depending on the routing form of the supply tube 102 moved along with the movement of the carriage 104 substantially parallel to the moving direction of the carriage 104.

Figure 10A:
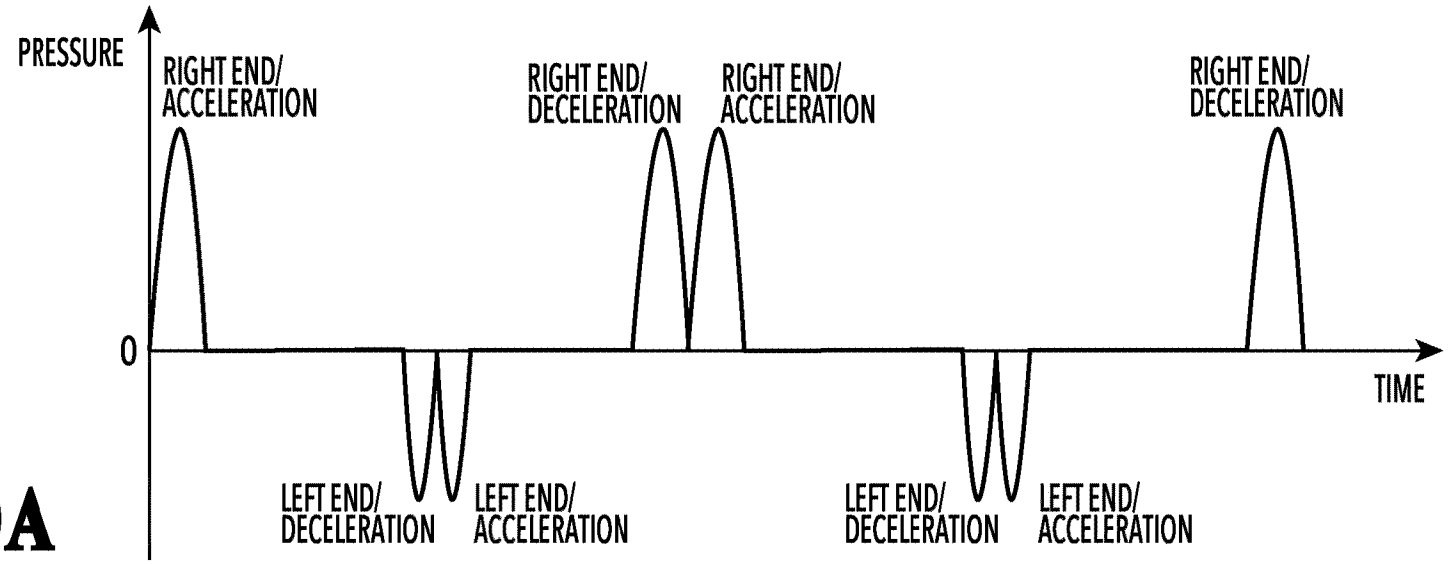
FIGS. 10A and 10B are diagrams describing a pressure variation in the printing head along with the movement of the carriage.
Figure 10B:
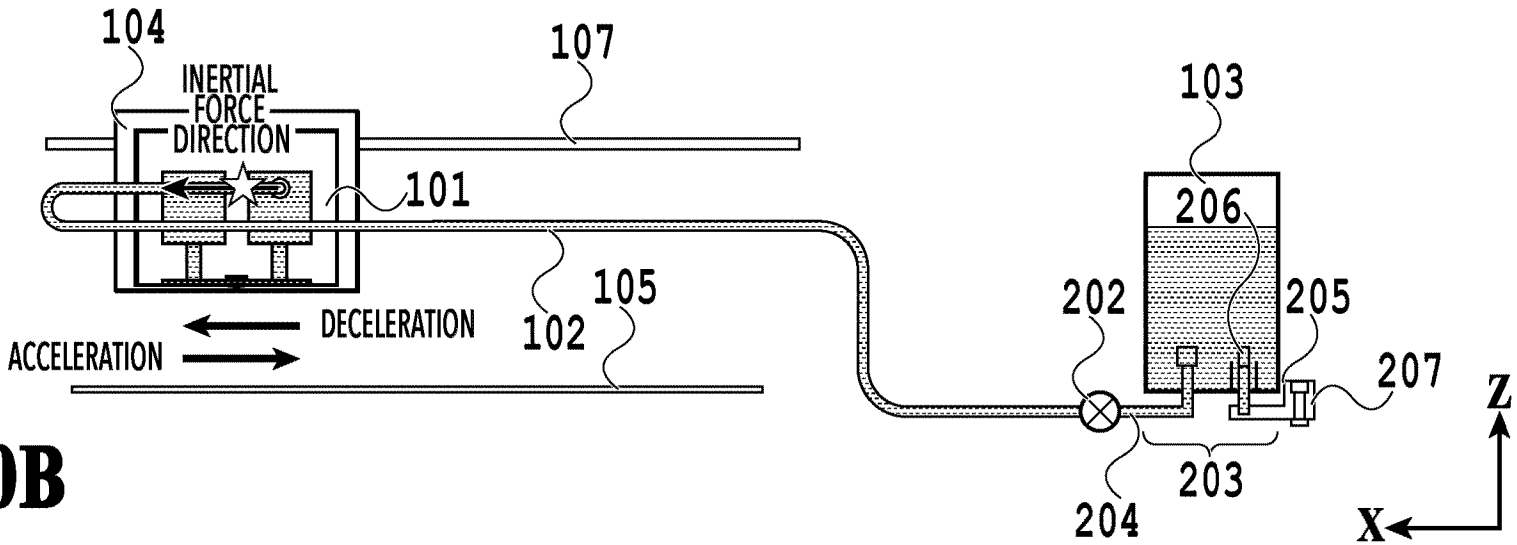

FIGS. 10A and 10B are diagrams describing a pressure variation in the printing head 101 along with the movement of the carriage 104 in the main scanning direction. FIG. 10A illustrates the changes in the pressure variation in the supply tube 102 if the carriage 104 scans reciprocally two times in the printing apparatus 100 with the tube arrangement as illustrated in FIG. 1. To be more specific, there are illustrated the changes in the pressure variation in the supply tube 102 that occurs in a portion immediately before the connection of the supply tube 102 and the printing head 101 (star sign in FIG. 10B). As illustrated in FIGS. 9A and 9B, depending on the arrangement of the supply tube 102, the inner volume and the mass of the ink in the tube to which the inertial force contributes are different between the acceleration and deceleration of the carriage 104 on the left end side and on the right end side in the main scanning direction. Consequently, if the carriage 104 on which the printing head 101 is mounted moves reciprocally at the same acceleration and deceleration speed on the right and the left, the magnitude of the inertial force is different between the acceleration and deceleration of the printing apparatus main body on the right end side and on the left end side. As illustrated in FIGS. 9A and 9B, the inner volume and the mass of the ink in the tube to which the inertial force contributes in the case where the carriage 104 is positioned on the right end side are greater than that of the case where the carriage 104 is positioned on the left end side. Accordingly, as illustrated in FIG. 10A, the magnitude of the pressure generated in the printing head 101 of the printing apparatus 100 of the tube arrangement as illustrated in the drawings such as FIGS. 9A and 9B is greater in the case of the acceleration and deceleration on the right end side than in the case of the left end side.

As illustrated in FIG. 10A, the pressure variation occurs instantaneously in the acceleration and deceleration on the right and left ends. Thus, in the example of the first embodiment, the ink flow is generated near the ejection port 401 only in the acceleration and deceleration, and the ink flow is hardly generated in the constant speed movement (printing) of the carriage 104.

In the light of circumstances, in this embodiment, an example in which a member capable of changing the expansion and contraction speed of the volume variable unit 406 depending on the scanning direction of the printing head 101 is provided is described. With this configuration, the instantaneous pressure variation is delayed in stages so that the pressure variation can occur also in the constant speed state.

Figure 11A:
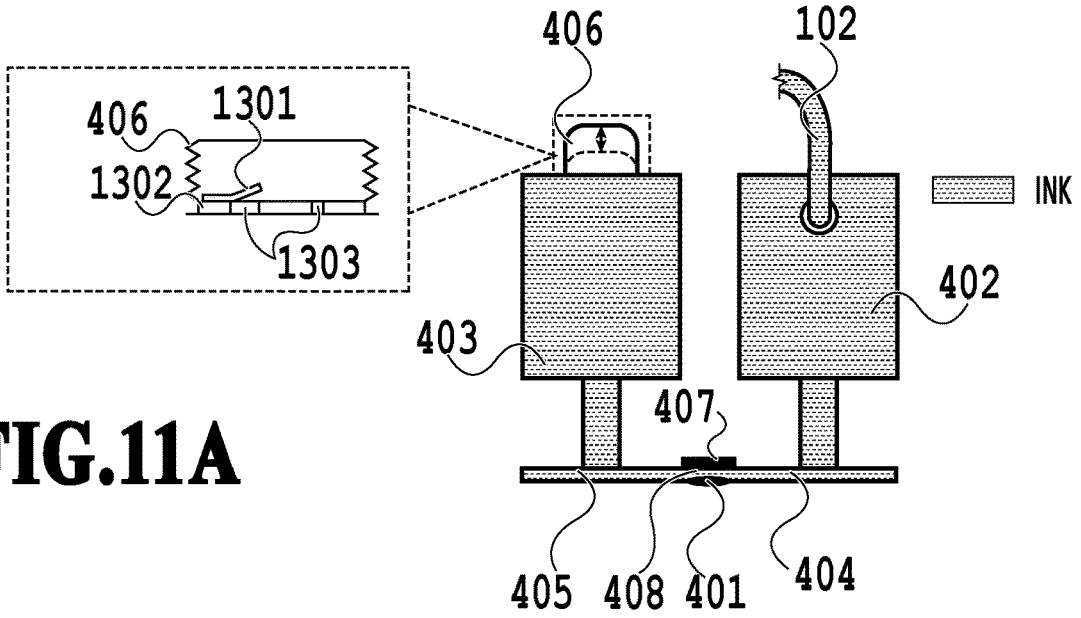
FIGS. 11A to 11D are diagrams describing the liquid chambers in the printing head.

FIGS. 11A to 11D are diagrams describing the liquid chambers in the printing head 101 of this embodiment. FIG. 11A is a schematic cross-sectional view of a configuration of the liquid chambers in the printing head 101. The volume variable unit 406 includes a partition 1302 therein to partition the second liquid chamber 403. Two air passages 1303 are provided in the partition 1302. Only one of the air passages 1303 is provided with an openable valve 1301. With the valve 1301 opening and closing, the one air passage 1303 to the volume variable unit 406 is opened and closed, and thus the amount of suction of the pressure into the volume variable unit 406 can be changed.

If the carriage 104 accelerates and decelerates on the right end side of the main body of the printing apparatus 100 as illustrated in FIG. 9A, a pressure is applied in the direction from the first liquid chamber 402 to the second liquid chamber 403 as described in the first embodiment. As described above, since the pressure variation occurs instantaneously in the acceleration and deceleration, once the volume variable unit 406 of the first embodiment is expanded instantaneously, the volume variable unit 406 then instantaneously tries to get back to the steady state. Consequently, the pressure variation is reduced in the constant speed movement of the carriage 104, and there is generated almost no ink flow near the ejection port 401.

Figure 11B:
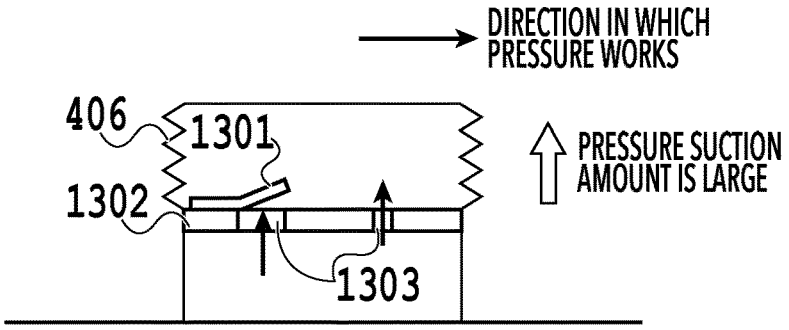
Figure 11C:
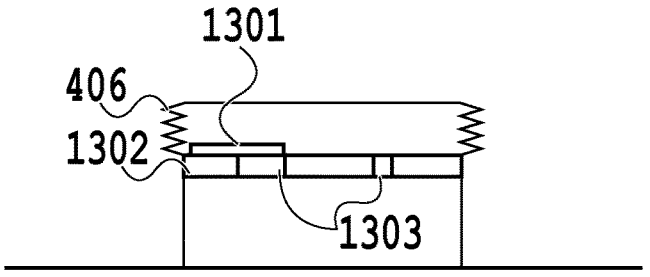

On the other hand, in the volume variable unit 406 of this embodiment, if a pressure is applied in the direction from the first liquid chamber 402 to the second liquid chamber 403, the valve 1301 is opened by the pressure as illustrated in FIG. 11B. Thus, the pressure is applied with both the two air passages 1303 opened, and the volume variable unit 406 is expanded. However, if the force works in the contract direction such that volume variable unit 406 gets back to the steady state, the valve 1301 is closed, and only one of the air passages 1303 is opened as illustrated in FIG. 11C. Consequently, the flow rate of the air during the contraction of the volume variable unit 406 is lower than that during the expansion. Accordingly, the speed of the contraction of the inner volume with respect to the speed of the expansion of the inner volume is slower. That is, if the pressure works due to the acceleration and deceleration, the ink is temporarily stored in the second liquid chamber 403 from the first liquid chamber 402 by the instantaneous expansion of the volume variable unit 406, but the contraction is made slowly to get back to the steady state. Thus, the pressure variation is not reduced instantaneously but decreased in stages little by little. Consequently, the pressure variation occurs also in the constant speed state of the carriage 104, and there is generated an ink flow near the ejection port 401.

Figure 11D:
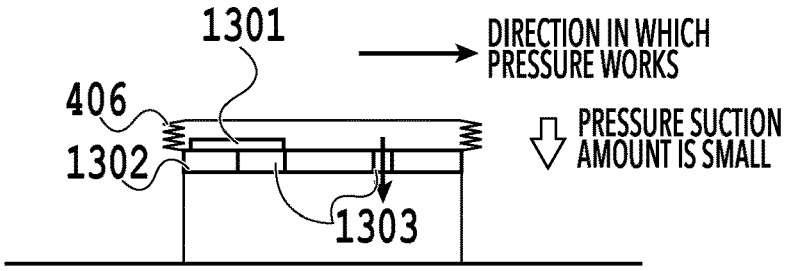

If the carriage 104 accelerates and decelerates on the left end side of the printing apparatus main body as illustrated in FIG. 9B, a pressure is applied in the direction from the second liquid chamber 403 to the first liquid chamber 402 as described in the first embodiment. Thus, as illustrated in FIGS. 11C and 11D, the volume variable unit 406 is contracted in stages little by little, and the ink flows are generated continuously. In this process, the ink tank 103 communicating with the first liquid chamber 402 side communicates with the atmosphere. Thus, unlike the case of the direction from the first liquid chamber 402 to the second liquid chamber 403, the ink never leaks from the ejection port 401 even without the instantaneous suction of the pressure variation. Getting back to the steady state is in the direction of the expansion of the volume variable unit 406. Thus, as illustrated in FIG. 11B, the two air passages 1303 allow the volume variable unit 406 to be expanded instantaneously, and the pressure variation is reduced instantaneously as well.

As described above, in this embodiment, even if the carriage 104 is in the constant speed state and not in the accelerating and decelerating scanning on the right and left ends, it is possible to generate a flow near the ejection port 401 and to inhibit the change in the characteristics of the ink near the ejection port 401. In this embodiment, the example of providing the two air passages 1303 is described; however, as long as the number of the opened passages is different between the expansion and the contraction, any configuration may be applied.

In the example of FIGS. 11A to 11D, the elastic member 412 illustrated in FIG. 4B is used as an example of the volume variable unit 406; however, the elastic member 411 illustrated in FIG. 4A may be used as the volume variable unit 406. In this case, the partition 1302 may have a common configuration with the liquid chamber inner wall 410.

Third Embodiment

In the first and second embodiments, the example in which the supply tube 102 is routed in the substantially J shape, and the shape of letter J is maintained even in the movement to the right and left ends in the main scanning direction is described. In this embodiment, an example in which the supply tube is routed in a circular shape is described. Additionally, an example in which the supply tube routed in the circular shape is moved with the reciprocal moving of the carriage substantially parallel to the scanning direction is described.

Figure 12A:
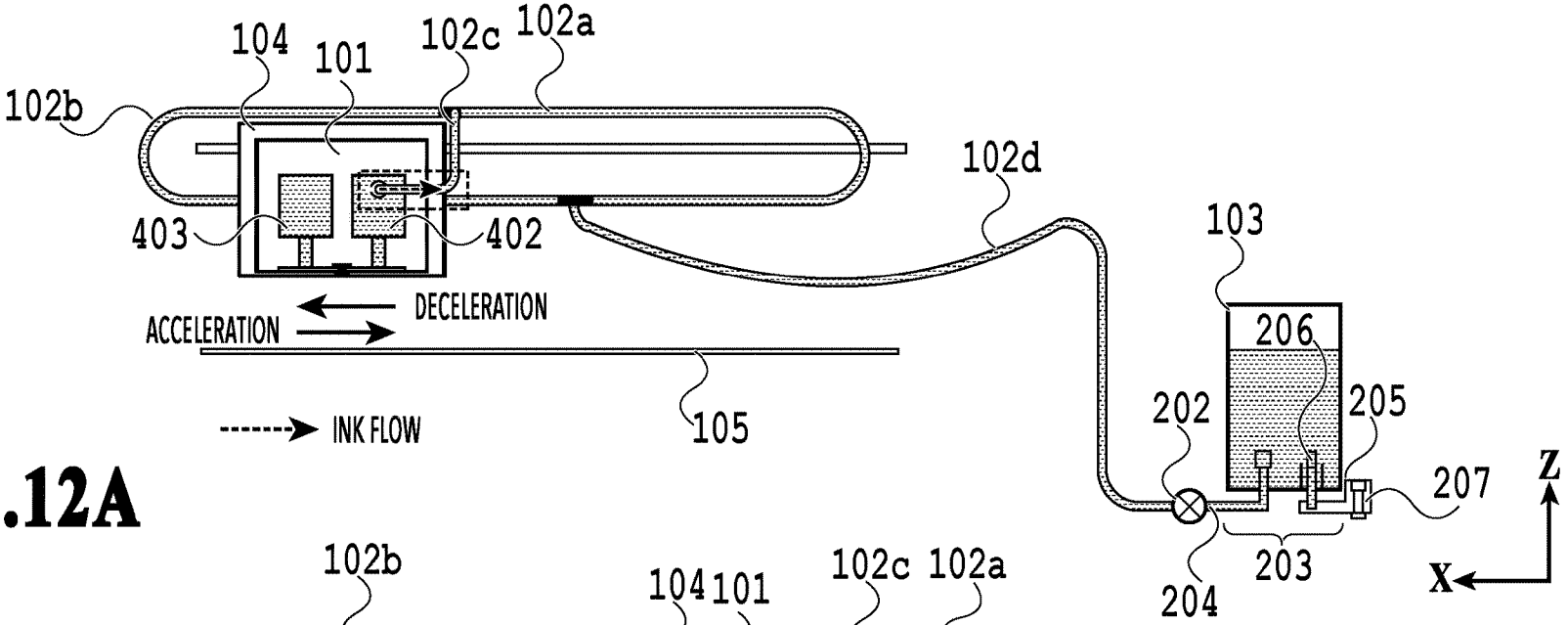
FIGS. 12A and 12B are diagrams illustrating paths of the ink from the ink tank to the printing head.
Figure 12B:
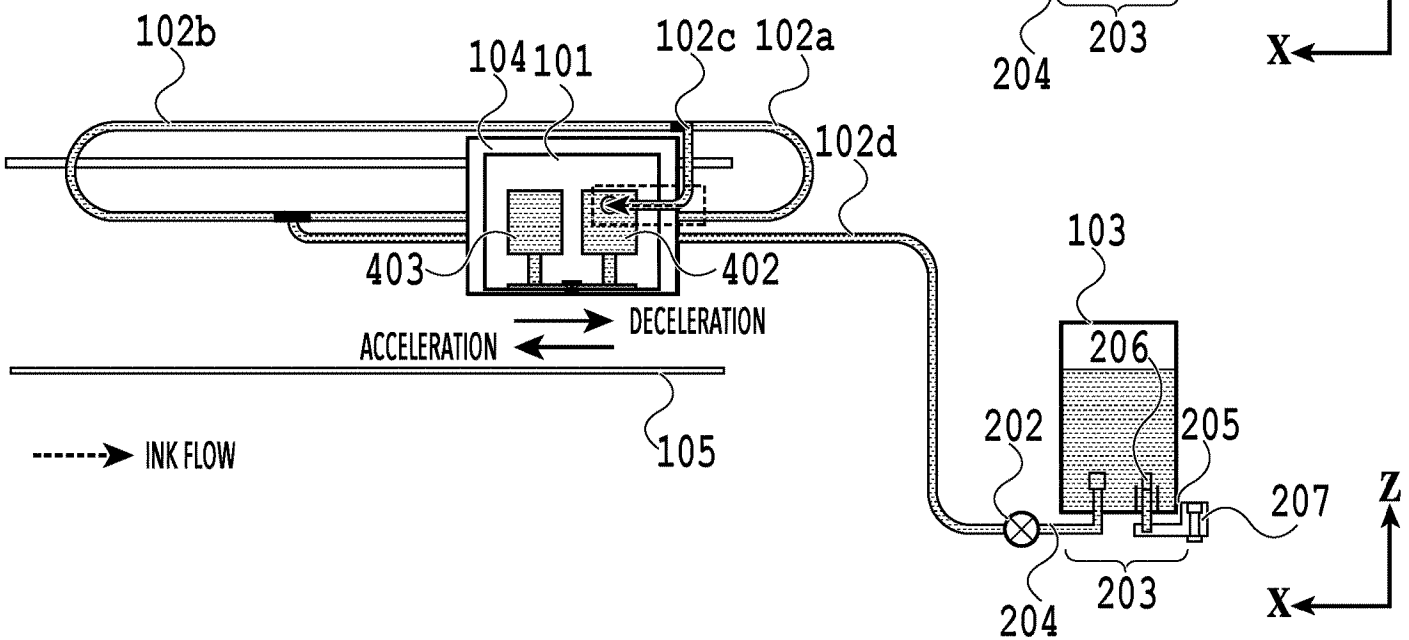

FIGS. 12A and 12B illustrate paths of the ink from the ink tank 103 arranged in a certain position in the apparatus main body to the printing head 101 of this embodiment. The supply tube in FIGS. 12A and 12B is formed of a first tube 102*a*, a second tube 102*b*, a third tube 102*c*, and a fourth tube 102*d*. In this embodiment, the tubes 102*a* to 102*d* are collectively called the supply tube 102. The ink in the ink tank 103 passes through the fourth tube 102*d*, branched into the first tube 102*a* and the second tube 102*b*, converged into the third tube 102*c*, and then supplied into the printing head 101. The tube circle formed of the first tube 102*a* and the second tube 102*b* is routed to be horizontal to an XZ plane, and the tube circle is moved horizontally in the X direction with the carriage 104 reciprocally moving rightward and leftward in the X direction. FIG. 12A is an example in which the carriage 104 is positioned on the left end side, and FIG. 12B is an example in which the carriage 104 is positioned on the right end side. It can be seen that a coupling portion of the first tube 102*a* and the second tube 102*b* and a coupling portion of the first tube 102*a*, the second tube 102*b*, and the third tube 102*c* are moved along with the movement of the carriage 104.

In such a system in which the supply tube 102 is routed in the circular shape, the pressure variation is compensated between the first tube 102*a* and the second tube 102*b*. Thus, the pressure variation actually working in the printing head 101 is in the portions indicated by frames of dotted lines in FIGS. 12A and 12B in the third tube 102*c* to which the first tube 102*a* and the second tube 102*b* are converged to be routed and connected to a supply port of the printing head 101. That is, the portion to which the inertial force contributes along with the reciprocal movement of the carriage 104 is the portion of the third tube 102*c*. In this embodiment, an example in which the third tube 102*c* is routed in the right direction with respect to the X-axis direction from the supply port of the first liquid chamber 402 of the printing head 101 is described. As illustrated in FIGS. 12A and 12B, the routing direction of the third tube 102*c* is not changed along with the reciprocal movement of the carriage 104.

An example in which the carriage 104 accelerates and decelerates on the left end side in the main scanning direction is described with reference to FIG. 12A. Once the carriage 104 accelerates and decelerates on the left end side in the main scanning direction, the inertial force is generated in the ink in the third tube 102*c* in the direction from the printing head 101 to the ink tank 103. During the printing operation, the opening/closing valve 202 in the ink tank 103 is in the open state. Consequently, as illustrated in FIG. 6B, the ink flows in the direction from the second liquid chamber 403 to the first liquid chamber 402.

An example in which the carriage 104 accelerates and decelerates on the right end side in the main scanning direction by the carriage 104 is described with reference to FIG. 12B. Once the carriage 104 accelerates and decelerates on the right end side in the main scanning direction, the inertial force is generated in the ink in the third tube 102*c* in the direction from the ink tank 103 to the printing head 101. That is, a pressure caused by the inertial force is applied in the direction from the first liquid chamber 402 to the second liquid chamber 403 in the printing head 101. In this process, the inner volume of the second liquid chamber 403 is expanded by the volume variable unit 406 as illustrated in FIG. 6D to store the ink flowed due to the pressurization, and the ink flows in the direction from the first liquid chamber 402 to the second liquid chamber 403.

In this embodiment, as illustrated in FIGS. 12A and 12B, although the movement amount of the ink is smaller than that of the first and second embodiments since the portion to which the inertial force contributes is smaller than that of the first and second embodiments, it is still possible to move the ink near the ejection port 401.

As described above, it is also possible to move the ink near the ejection port 401 by the acceleration and deceleration scanning of the carriage 104 on the right and left ends in the printing apparatus in which the supply tube 102 is in the circular shape in the middle of the way from the ink tank 103 to the printing head 101.

The diameters of the flows of the first tube 102*a* and the second tube 102*b* forming the tube circle and the third tube 102*c* from the tube circle to the printing head 101 may be different from each other. It is possible to increase a shaking range of the ink in the printing head 101 by making the path having different channel resistances by changing the diameters of the flows. For example, a case where the tube diameters of the first tube 102*a*, the second tube 102*b*, and the third tube 102*c* are φ3, φ1, and φ5, respectively, is assumed. In this case, since the channel resistance of the third tube 102*c* is smaller than that of the second tube 102*b*, the pressure variation due to the serial scanning is more likely to be propagated into the third tube 102*c*, and thus the change in the characteristics of the ink can be solved.

For the configuration of the tube circle of the third embodiment, it is possible to apply the volume variable unit 406 with different expansion and contraction speed as described in the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-149062, filed Aug. 15, 2019, which is hereby incorporated by reference wherein in its entirety.

What is claimed is:

1. A printing apparatus, comprising:

a tank configured to store ink;

a printing head provided with an ejection port to eject ink and a pressure chamber to be filled with ink and configured to perform reciprocal moving; and a supply channel configured to supply ink from the tank to the printing head, wherein the printing head includes a first liquid chamber provided with a connection portion with the supply channel, a second liquid chamber configured to communicate with the first liquid chamber by way of the pressure chamber, and a volume variable unit configured to change an inner volume of the second liquid chamber.

2. The printing apparatus according to claim 1, wherein the volume variable unit includes a wall arranged in the second liquid chamber and movable according to a pressure, and an elastic member joined to the wall.

3. The printing apparatus according to claim 1, wherein the volume variable unit includes a flexible member arranged in the second liquid chamber.

4. The printing apparatus according to claim 1, wherein the volume variable unit is formed such that a speed of expansion of the inner volume and a speed of contraction of the inner volume are different from each other.

5. The printing apparatus according to claim 4, wherein the volume variable unit includes a partition member configured to partition inside the volume variable unit, a plurality of passages provided in the partition member, and a valve configured to open and close at least one of the passages according to a pressure variation.

6. The printing apparatus according to claim 1, wherein the tank is fixed to a predetermined position in the printing apparatus.

7. The printing apparatus according to claim 1, wherein the supply channel is formed of a flexible member.

8. The printing apparatus according to claim 7, wherein the flexible member is a tube.

9. The printing apparatus according to claim 8, wherein the tube is routed in a direction substantially parallel to a direction of the reciprocal moving by the printing head, and the routing direction is not changed along with the reciprocal moving by the printing head.

10. The printing apparatus according to claim 8, wherein the tube is routed in a circular shape.

11. The printing apparatus according to claim 1, further comprising:

a carriage configured to move reciprocally with the printing head mounted thereon.

12. The printing apparatus according to claim 1, wherein the printing head includes a first channel configured to connect the first liquid chamber and the pressure chamber, and a second channel configured to connect the pressure chamber and the second liquid chamber.

13. The printing apparatus according to claim 12, wherein the printing head includes a plurality of the ejection ports, and the first channel and the second channel are connected with each ejection port.

14. The printing apparatus according to claim 1, wherein the tank is opened to atmosphere during the reciprocal moving by the printing head.

15. The printing apparatus according to claim 1, wherein the printing head includes an energy generation element, and the generated energy from the energy generation element affects ink in the pressure chamber.

16. The printing apparatus according to claim 15, wherein the energy generation element is arranged in the pressure chamber.

* * * * *